US005970542A

United States Patent [19]

Mays

[11] Patent Number: 5,970,542

[45] Date of Patent: Oct. 26, 1999

[54] FOOT POUCH BLANKET

[76] Inventor: Steven R. Mays, P.O. Box 659, Pleasant Grove, Ala. 35127

[21] Appl. No.: 09/031,099

[22] Filed: Feb. 26, 1998

Related U.S. Application Data

[60] Provisional application No. 60/038,608, Mar. 6, 1997.

[51] Int. Cl.[6] ..... A47G 9/02; A47G 9/00

[52] U.S. Cl. ..... 5/485; 2/69.5

[58] Field of Search ..... 5/485, 482, 494; 2/69, 69.5, 247, 253

[56] References Cited

U.S. PATENT DOCUMENTS

| | | | |
|---|---|---|---|
| 174,920 | 3/1876 | Milwain | 5/485 |
| 175,252 | 3/1876 | Milwain | 5/485 |
| 799,080 | 9/1905 | Nielsen | 5/485 |
| 1,169,385 | 1/1916 | St. Clair Ede | 2/69 |
| 1,425,952 | 8/1922 | Fidler | 5/485 |
| 1,863,256 | 6/1932 | Snoddy | 5/494 |
| 2,146,400 | 2/1939 | Maker et al. | 2/69 |
| 3,521,309 | 7/1970 | Evans | 5/494 |
| 4,045,831 | 9/1977 | Clark | 5/485 |
| 4,627,123 | 12/1986 | Uggerud | 5/485 |
| 5,509,156 | 4/1996 | Smith | 5/485 |

FOREIGN PATENT DOCUMENTS

| | | | |
|---|---|---|---|
| 176816 | 5/1953 | Austria | 2/69.5 |

*Primary Examiner*—Alex Grosz

[57] ABSTRACT

A blanket for use beyond the bed is described. The inventive blanket having a pouch at the foot end (10) for a person to place their feet, keeping them covered and thus keeping them warm. As the occupant (8) moves around, pulls or tugs to get comfortable, their feet remain covered. A particularly preferred embodiment comprises a blanket folded at the bottom (4) to create the pouch, stitched (5) on each side of the pouch to secure it, and reinforced stitching on each top corner (7) and also at the top center (6) of the pouch.

1 Claim, 5 Drawing Sheets

FOOT POUCH BLANKET

This application is based on Provisional Application No. 60/038,608 filed Mar. 6, 1997.

BACKGROUND

1. Field of Invention

This invention relates to a blanket/throw and it's use beyond the bed, with the addition of a pouch/pocket t contain a person's feet, keeping the feet covered and thus keeping them warm.

2. Description of Prior Art

Blankets are commonly used in other places besides a person's bed. They are used as a person is reading, sitting in a chair, or watching television. Other places would be napping on the couch, or in the stadium at the ballgame.

Blankets being used in these situations share a common problem. When a person turns, pulls or shifts around, the blanket moves exposing the person's feet to the cold. This causes discomfort, frustration and is a distraction from one's activities.

In March of 1876, U.S. Pat. Nos. 174,920 and 175,252 to Milwain discloses designs that are similar but was to keep a person warm while traveling in a horse drawn carriage; however, this design reflects a lap robe with foot pockets and also a rug with foot pockets attached to the carriage. The lap robe to be a bag one might step in, totalling containing a person from the waist down, this restricts easy access to step out of this robe. These designs are also not suitable with our present status for traveling.

U.S. Pat. No. 1,863,256 to Snoddy (1932) shows a baby blanket designed to contain a child and to keep the blanket secure. This was designed around a baby crib and to be used on a mattress, not being applicable beyond that.

Several blankets and sheets have been designed with pockets, but have been focalized for a bed. U.S. Pat. No. 3,521,309 to Evans (1970) represents a crib sheet with additional material sewn on three sides to produce a pocket, in essence a baby sleeping bag designed for a crib. U.S. Pat. No. 4,045,831 to Clark (1977), a bed sheet with a pocket to secure a blanket from being pulled out from under the mattress, U.S. Pat. No. 4,627,123 to Uggerud (1986), a bed tick, which is the sturdy fabric used to cover a mattress, with a pocket for the user's feet; and U.S. Pat. No. 5,509,156 to Smith (1996), a foot blanket that encases the foot end of the mattress allowing the occupant to place their feet under or over the blanket. All of these patents are focused on designs for foot pockets, but for a bed, or in Milwain's case, a carriage. None of these designs are practical or usable beyond the application of a bed or a carriage.

OBJECTS AND ADVANTAGES

Accordingly, several objects and advantages of my invention are:

(a) to provide a blanket that is designed to be used beyond the bed, that keeps the feet covered, by way of a foot pouch in the bottom of the blanket;

(b) to provide a blanket with a foot pouch, that will keep a person's feet covered at all times, even when they pull, tug, or move around to get comfortable or to relocate;

(c) to provide a blanket with a foot pouch to contain body heat and thus keeping warm;

(d) to provide a blanket with a foot pouch that is sewn and secured, that can not be undone, providing easy use and comfort, eliminating delays and frustration;

(e) to provide a blanket with a foot pouch, that does not restrict movement, but provides complete freedom to move one's feet within the blanket's pouch, and also easy access to step out of;

(f) to provide a blanket with a foot pouch, in woven and non-woven materials that the consumer can afford and is also comfortable;

Further objects and advantages are to provide a blanket with a foot pouch/pocket which can be used easily and conveniently, which is simple to use and inexpensive to manufacture, which can be provided in woven and non-woven materials, which can be manufactured in various sizes to accommodate one or more people, which can be used in various locations beyond a bed, like the couch, chair, fishing boat, tree stand, ballpark stadium, wheelchair, office chair, anywhere a person wishes to keep their feet covered, providing the ability to contain their body heat and warm.

DRAWING FIGURES

In the drawings, closely related figures have the same number but different alphabetic suffixes.

REFERENCE NUMERALS IN DRAWING

4—blanket

5—stitch on each side of the pouch

6—stitch, commonly called a dart, for reinforcement

7—triangle stitch in the corners of the top of the pouch for reinforcement

8—person standing in inventive foot blanket illustrating the advantage

9—person sitting within the inventive foot blanket illustrating the advantage

10—completed inventive foot blanket

SUMMARY

The principal point of my invention is a blanket designed to be used beyond the a foot pouch/pocket in the bottom to keep a person's feet covered at all times, no matter how much a person moves, pulls, twist around. The desired result in containing body heat and keeping warm in any location desired is accomplished.

DETAILED DESCRIPTION—FIGS. 1 TO 3A

Figure 1:
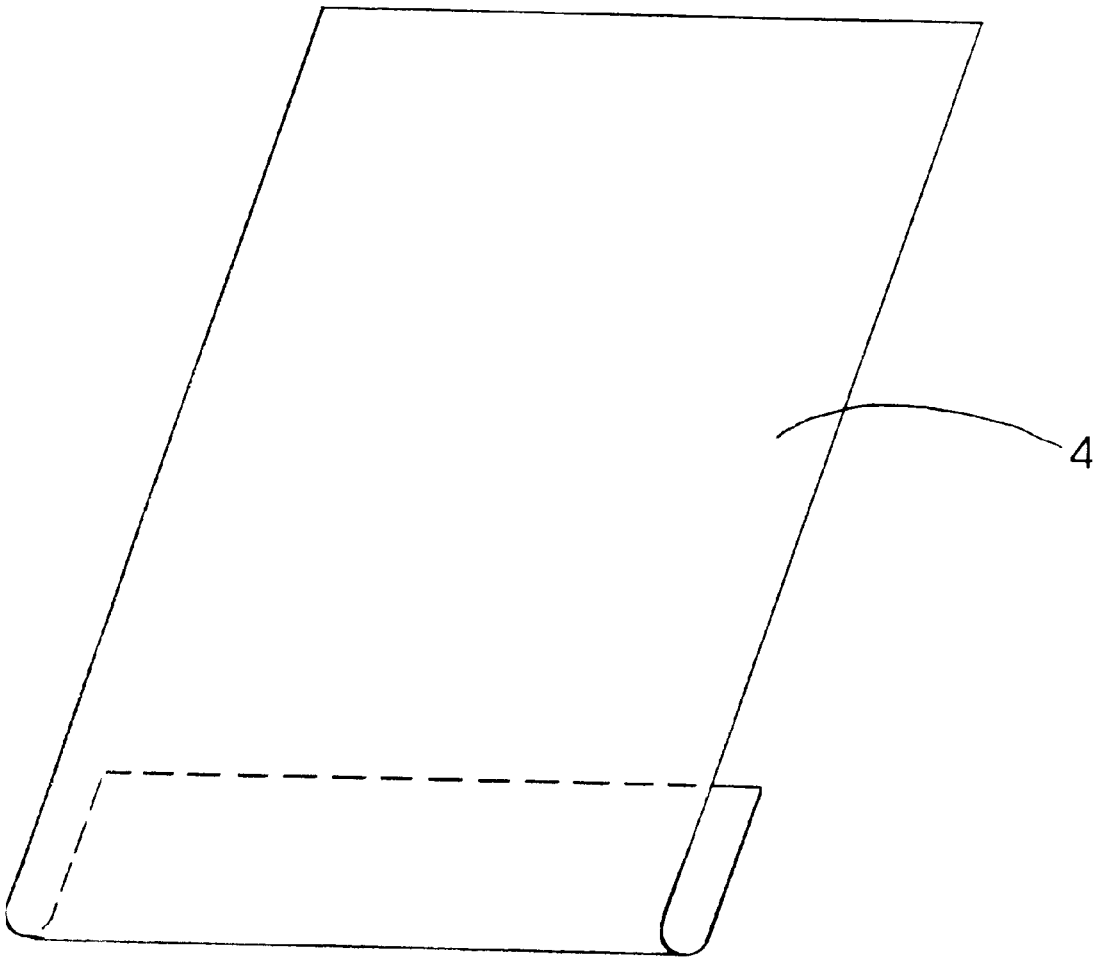
FIG. 1 shows the first stage of how the inventive foot blanket is manufactured, with a overlay of material to create the pouch.

FIG. 1 illustrates the first step in the making of the inventive foot blanket. A blanket 4, is folded at the bottom to create the potential foot pouch. This folded portion of the blanket can be at least 8 inches and no more than 24 inches.

Figure 2:
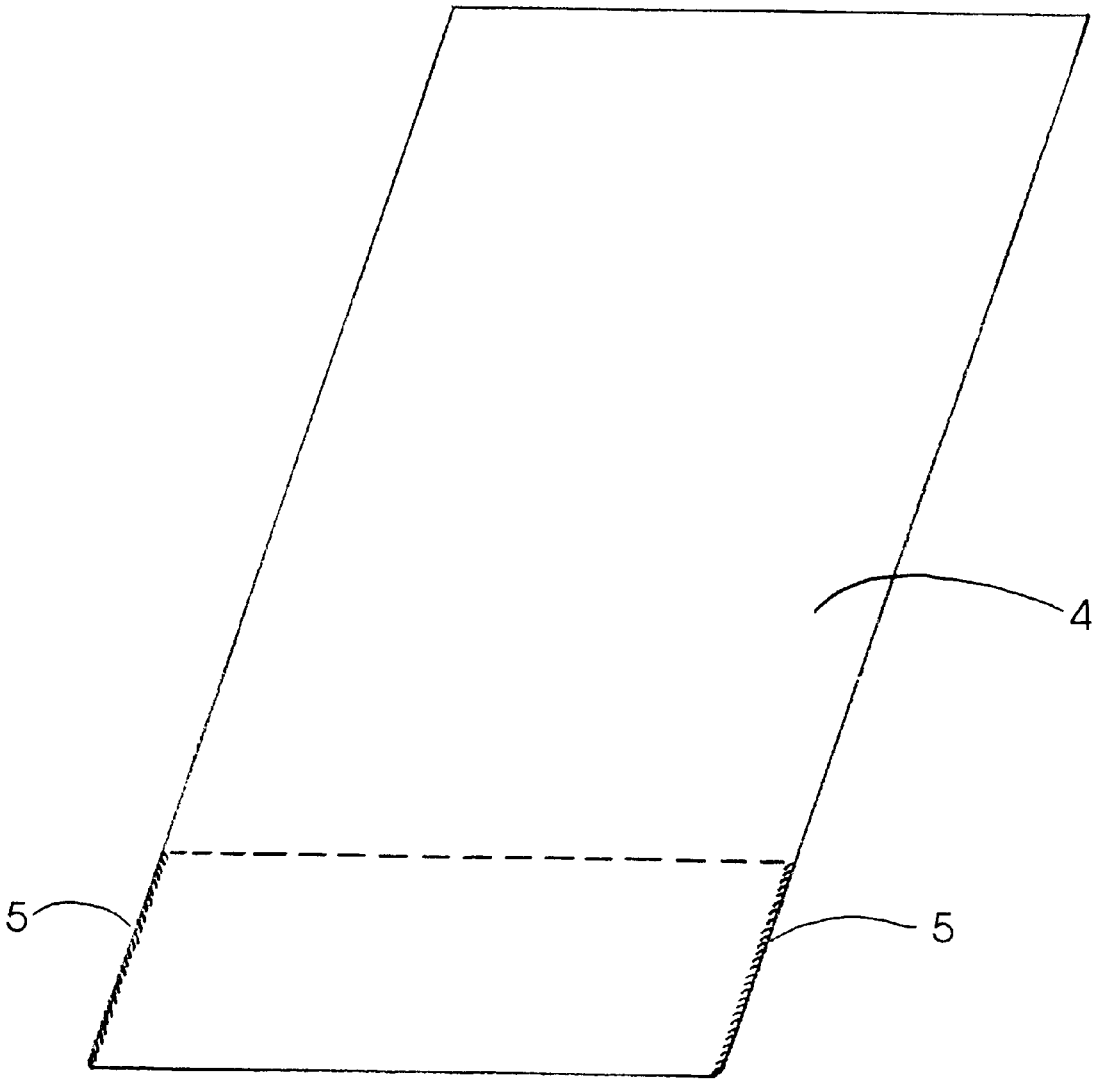
FIG. 2 and FIG. 2A shows the preferred embodiment of the inventive foot blanket, sewing the edges of the pouch.

FIG. 2 shows the blanket 4, with the folded portion creating the foot pouch and stitching 5 down each side of the foot pouch to secure in place. A surged sewn stitch is the preferred stitch, but any stitch will provide the security of the foot pouch. This is the preferred embodiment of the inventive foot blanket.

Figure 2A:
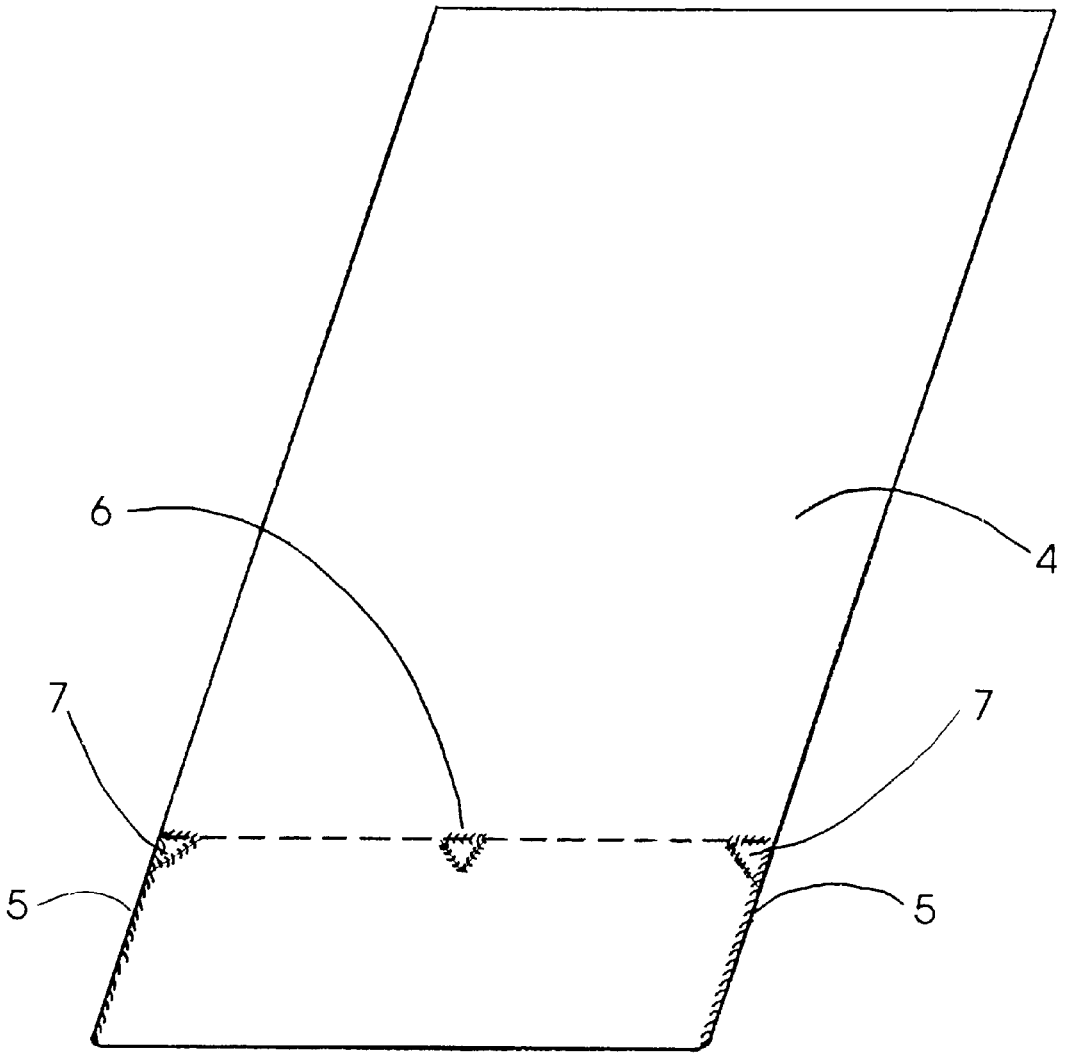

FIG. 2A is the preferred embodiment of the inventive foot blanket that would accommodate more than one person.

FIG. 2A shows the blanket 4, with the folded portion creating the foot pouch and stitching 5 down each side of the foot pouch to secure in place. A stitch, commonly known as a dart 6 is placed in the top center of the foot pouch. This is to provide stability for the foot pouch and to keep the foot pouch from drooping in the center. A triangle stitch 7 is placed in each top corner of the foot pouch to provide strength and reinforcement to the foot pouch.

Figure 3:
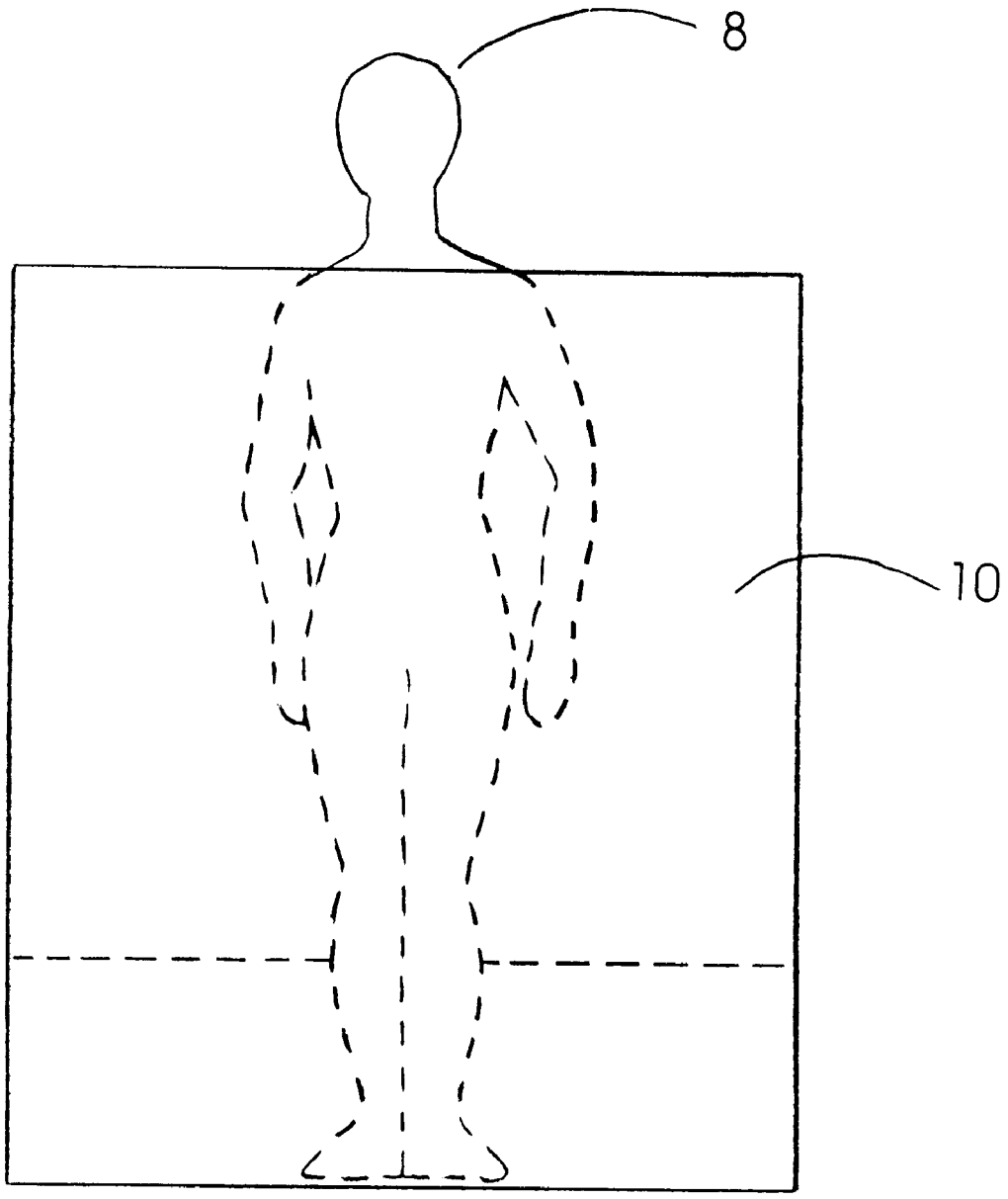
FIG. 3 and FIG. 3A is a partial view illustrating the utility and advantage offered by the inventive foot blanket wherein one can keep their feet covered at all times.

FIG. 3 is a partial view of the inventive foot blanket illustrating the utility. In FIG. 3 the view is a person standing 8 in the completed inventive foot blanket 10. This view shows how the person standing 8 is covered and that their feet is placed in the foot pouch. The occupant's feet are not restricted in movement in any way. This accommodates the occupant as they would move to get settled and comfortable, keeping their feet covered at all times. Also, providing easy access to step out of the pouch.

Figure 3A:
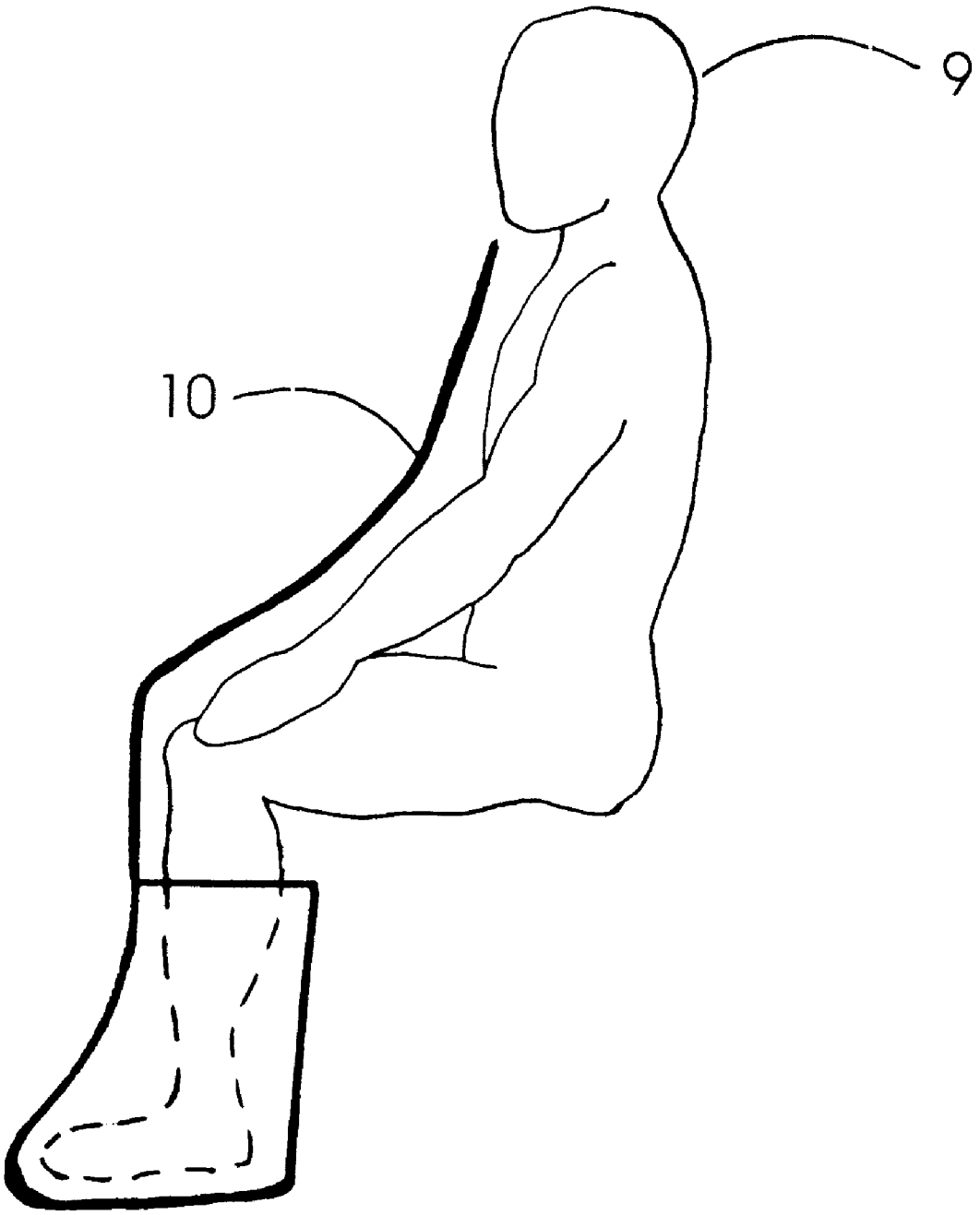

FIG. 3A is a partial view of the inventive foot blanket illustrating the utility. In FIG. 3A, the view is a person sitting 9 in the completed inventive foot blanket 10. This side view shows how the person sitting 9 is covered and that their feet are placed in the pouch of the completed inventive foot blanket 10. This view shows how the occupant's feet are secure and will continue to be covered even when the occupant moves to get settled or comfortable.

The width of the foot blanket, as measured from side to side, is preferably at least 30 inches and not more than 85 inches. The width is preferably chosen to be suitable for use for one person up to two people. For use of one person the preferred width is no less than 30 inches and no more than 72 inches. For use of two people the preferred width is no less than 50 inches and no more than 85 inches.

The length of the foot blanket, as measured from top to bottom is chosen for comfort. Preferably, the length of the foot blanket is no less than 42 inches and no more than 78 inches. For a child, the prefered length is no less than 42 inches and no more than 60 inches. For an adult, the prefered length is no less than 60 inches and no more than 78 inches.

The length of the pouch of the foot blanket, as measured from the top of the pouch to the bottom of the foot blanket is chosen for comfort. Preferably, the length of the pouch is chosen such that it reaches approximately seventy-five percent of the distance from the occupant's feet to the knee. Preferably, the length of the pouch is no less than 8 inches and no more than 24 inches.

The material of construction is not limiting with the exception of being limited to materials which are commonly used for making blankets. Specifically preferred are natural fibers such as cotton, wool or synthetic materials such as polyester and nylon. Blends are also known to be useful and are suitable for use herein. Blends of cotton and polyester are particularly preferred, woven and non-woven.

SUMMARY, RAMIFICATIONS, AND SCOPE

Accordingly, the reader will see that this invention can be used easily and conveniently, that it will always keep a person's feet covered, providing warmth and comfort. In addition, this blanket with a pouch, can be used in many locations that a person desires that their feet stay covered, that this invention can be manufactured in a variety of fabric type materials, non-woven for an inexpensive product yet practical, and in woven plush fabric type materials for maximum comfort and warmth. Furthermore, this invention can be manufactured in a variety of sizes to accommodate one or more people. The additional advantages are that:

- it provides a practical alternative to a conventional blanket;
- it provides a solution to the problem when a blanket comes off or is pulled, uncovering the person's feet;
- it provides the ability to contain body heat;
- it provides the ability to be comfortable and to be warm;
- its sewn design eliminates assembly, thus eliminating delay and frustrations.

Although the description above contains many specificities, these should not be construed as limiting the scope of the invention but as merely providing illustrations of some of the presently perferred embodiments of this invention. For example, the foot blanket can have other accessories, such as a draw string cord to secure around a person's feet, or buttons to also secure, Velcro® to secure and/or an elastic band for security. Zippers or buttons could be used to create the pouch. The foot blanket can be manufactured in any material, woven and non-woven, that would serve as a blanket, and can be manufactured in all colors and in all print designs.

Thus the scope of the invention should be determined by the appended claims and their legal equivalents, rather than by the examples given.

I claim:

1. A foot pouch blanket with a pouch at the foot end to be used beyond a bed, to contain and secure a person's feet from being uncovered comprising:

of a blanket that is folded at the bottom to create a pouch for the feet;

with stitching on each side of the pouch, to secure the pouch in place, also additional stitching, commonly known as a dart, in the top center of the pouch, to keep it from drooping in the middle, with triangle stitching on each top corner of the pouch for strength and reinforcement;

said blanket having a width of at least 30 inches and no more than 85 inches, said blanket having a length of at least 42 inches and no more than 72 inches, said blanket having the length of the pouch to be at least 8 inches and no more than 24 inches.

* * * * *